US006393744B1

(12) United States Patent
Snyder

(10) Patent No.: US 6,393,744 B1
(45) Date of Patent: May 28, 2002

(54) ROTATING TURBULENT FLOW DISPLAY DEVICE

(76) Inventor: Robert D. Snyder, 1010 Donalee, Monroe, MI (US) 48162

( * ) Notice: Subject to any disclaimer, the term of this patent is extended or adjusted under 35 U.S.C. 154(b) by 0 days.

(21) Appl. No.: 09/405,998

(22) Filed: Sep. 24, 1999

Related U.S. Application Data

(60) Provisional application No. 60/101,879, filed on Sep. 25, 1998.

(51) Int. Cl.[7] ..... G09F 19/00

(52) U.S. Cl. ..... 40/406; 40/409; 40/427; 40/430

(58) Field of Search ..... 40/406, 409, 427, 40/429, 430

(56) References Cited

U.S. PATENT DOCUMENTS

| | | | | |
|---|---|---|---|---|
| 2,282,430 A | | 5/1942 | Smith | |
| 2,770,073 A | | 11/1956 | Sullivan | |
| 3,874,102 A | | 4/1975 | Sheppard | |
| 4,177,592 A | | 12/1979 | Ruck | |
| 4,490,931 A | | 1/1985 | Fleemin | |
| 4,949,485 A | | 8/1990 | Garrett | |
| 5,050,976 A | | 9/1991 | Chuang | |
| 5,052,714 A | | 10/1991 | Muscat et al. | |
| 5,146,701 A | | 9/1992 | Lee | |
| 5,156,550 A | | 10/1992 | Alexander | |
| 5,189,821 A | | 3/1993 | Lee | |
| 5,272,604 A | | 12/1993 | Lin | |
| 5,301,444 A | | 4/1994 | Horiuchi | |
| 5,435,086 A | | 7/1995 | Huang | |
| 5,706,594 A | * | 1/1998 | Lin | 40/406 |
| 5,875,577 A | * | 3/1999 | Lu | 40/406 |
| 5,946,968 A | * | 9/1999 | Lee | 40/406 |

* cited by examiner

*Primary Examiner*—Anthony Knight
*Assistant Examiner*—Enoch Peavey
(74) *Attorney, Agent, or Firm*—Young & Basile, PC

(57) ABSTRACT

A rotating turbulent display device is disclosed as comprising a transparent display cell having an outer surface and an inner chamber which may be filled with various substances and structures including liquid, granular particles or a rigid member adapted to displace the substances within the inner chamber of the display cell. The device is mounted within a base unit having a complementary aperture for receiving the outer surface of the display and a motor therein which operates to rotate the display cell at a predetermined rotational speed and direction to simulate the passage of time thereby creating a visible flow pattern within the inner chamber of the display cell.

12 Claims, 4 Drawing Sheets

ROTATING TURBULENT FLOW DISPLAY DEVICE

CROSS-REFERENCE TO CO-PENDING APPLICATION

This application claims the benefit of the priority filing date of the U.S. Provisional Application Serial No. 60/101,879 filed Sep. 25, 1998.

BACKGROUND OF THE INVENTION

1. Field of the Invention

The present invention relates generally to rotating turbulent flow display devices and in particular to a display device which continuously rotates at a predetermined rate.

2. Description of the Art

Display devices which exhibit visible turbulent flow patterns in response to movement are known. An example is the so-called oscillating wave cell. That type of display device includes a transparent chamber mounted on a base. Typically the chamber includes one or two immiscible liquids which when oscillated within the chamber create a visible flow pattern. The liquid-filled chamber is oscillated back and forth by a drive mechanism mounted within the base.

U.S. Pat. No. 5,189,821 discloses another display device in which two immiscible liquids are disposed within a transparent chamber. A motor containing two rotatable output shafts is mounted in a separate chamber below the liquid filled chamber. A horn-shaped diaphragm having magnets at lower, outer end portions is mounted within the liquid chamber. Rotation of the motor output shafts causes magnets mounted on the motor output shafts to alternately attract and repulse the magnets on the diaphragm thereby causing the diaphragm to reciprocal up and down about a central fixed post. This reciprocal movement of the diaphragm creates waves in the liquids in the chamber.

U.S. Pat. No. 5,272,604 discloses a cyclonic liquid display ornament in which two or more liquids having different specific gravities are disposed in a first chamber. A centrifugal impeller is mounted at the bottom portion of the first chamber and interacts with a magnetic element mounted on the output shaft of the motor disposed in a separate chamber immediately below the first chamber. Rotation of the motor output shaft causes corresponding rotation of the impeller which creates a vortex within the liquid of lesser specific gravity to create a cyclone within the first chamber.

While the above-described prior art display devices provide interesting and pleasing visible patterns within the liquid, it is desirable to provide a display device which continuously rotates within a base a predetermined rate selected to simulate the movement of time. Thus, contrary from the prior art liquid display devices described above, it is desirable not only to provide a display device including an inner chamber filled with a substance capable of creating a disorderly visible flow pattern when rotated, but to rotate the outer surface of the cell in an orderly continuous manner to simulate the passage of time. To further reinforce the association between the movement of the display cell and the passage of time, it is also desirable to provide a timepiece on this display device.

SUMMARY OF THE INVENTION

The present invention is a rotating turbulent flow display device which includes a transparent display cell having an outer surface and an inner chamber. The display cell is received in a base unit which has a complimentary aperture designed to receive the outer surface of the display cell and to permit rotation of the display cell therein. Rotation of the display cell is achieved by means of a motor mounted within the base unit. The motor includes a rotatable member, such as a wheel, operably engaged to the outer surface of the display cell to continuously rotate the display cell. The rotational output of the motor requires no manual adjustment or input to continue the display generation and can be preset to visually represent the passage of time. It may be preset to rotate at any given rate, but, to simulate the passage of time while providing sufficient rotation to insure flow of the display cell contents, for example, the rotational rate of the cell can be one revolution per minute.

To enhance the visual representation of time passage, the contents of the display cell can be varied. For example, substances within the inner chamber of the display cell may include a combination of fluid or solid particles which are capable of creating a pleasing visible flow pattern in response to the rotational movement of the display cell. These substances would include, but are not limited to, fluid capable of generating distinguishable patterns during flow such as liquid soap sold under the trademark "SOFT SOAP" which includes glycol stearate which provides pearlescence characteristics, 45 drops of Winsor Newton Royal Blue water color, a plurality of particles, such as plastic beads, sand, or a plurality of light sensitive particles. The tumbling, turbulent flow of substances within the display cell creates a visual representation of the "flow" of time.

A variety of flow patterns can be achieved by mounting a rigid member in the inner chamber of the display cell which is adapted to displace the contents of the inner chamber as the cell rotates. Depending on the direction and rate at which the display cell rotates, the rigid member within the inner chamber can simulate the hand of a clock. For example, if the motor rotates the display cell at one revolution per minute in a clockwise direction, the rigid member simulates a second hand on a clock. The rigid member may be of any shape, but is preferably saw-tooth shaped to maximize displacement of contents in the inner chamber of the display cell. The rigid member may also be shaped so as to create a subchamber within the inner chamber of the display cell. In such an embodiment, the rigid member has an outer peripheral edge mounted to an inner surface of the display cell and an inner peripheral edge which is formed to create a subchamber within the display cell. The subchamber, then, may be filled with a liquid or solid substance or combination of the two. Alternatively, the rigid member may also be transparent.

The representation of time passage is further enhanced by mounting a timepiece on the base unit. The output of the timepiece may, in an alternative embodiment, provide an input to the motor so that the position of the rigid member may be representative of a unit of time. For example, if the timepiece read 12:00, the rigid member would be positioned to indicate the "12" position on a traditional analog clock. Alternatively, the speed and direction of the motor could be preset to rotate independently of the timepiece, nevertheless correlating to the time shown.

The display device may provide further visual stimulation by including ultraviolet light sensitive substances within the inner chamber of the display cell. Thus, under low room light or no light at all, stimulated UV sensitive particles will create a variety of pleasing flow patterns upon rotation. The base unit itself may incorporate at least one, preferably two light source(s) such as an LED source, a UV source, etc. In one embodiment, the light source would be positioned so that the light output would illuminate the display cell contents. The light source power supply is further positioned in the base unit and operably connected to the light source.

As an alternative, an ultraviolet lamp may be mounted in the base unit to shine upon the contents of the cell. In such an embodiment, the display cell may contain a plurality of plastic particles which fluorescence under UV light. The UV sensitive particles may also be combined with non-UV sensitive particles resulting in another flow pattern of substances within the display cell. Of course when selecting materials for the inner chamber of the display cell, it is preferable to select those which will not damage the interior surface of the display cell during rotation. Preferably, the solid particles are made of a suitable plastic.

The outer surface of the display cell may have any suitable shape adapted to permit rotation within the base unit. It may be spherical or disc shaped, for example. In a preferred embodiment, the display cell is disc shaped and is formed by a pair of opposed planar surfaces spaced apart from one another to create the inner chamber of the cell. The planar surfaces are sealingly joined to one another forming an outer peripheral surface about the outer surface of the display cell. In this embodiment, the display cell also includes a flange having opposed ends which extend axially beyond the opposed surfaces of the display cell. The opposed ends of the flange are received in a complementary groove formed in the base unit. Specifically, the base unit includes a pair of opposed upstanding members between which the outer surface of the display cell rotates. Opposed ends of the flange are received in respective complementary grooves formed in each respective upstanding member so as to rotatably secure the display cell within the base unit. As an alternative embodiment, the flange may be formed as an integral part of the rigid member. In that embodiment, the flange would have a T-shaped cross section where the base of the T is received between the planar surfaces of the display cell and the top of the T would form the flange expanding the width of the display cell.

The display of the present invention provides a turbulent, constantly changing visual flow pattern which can be synchronized to the passage of time.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENTS

Figure 1:
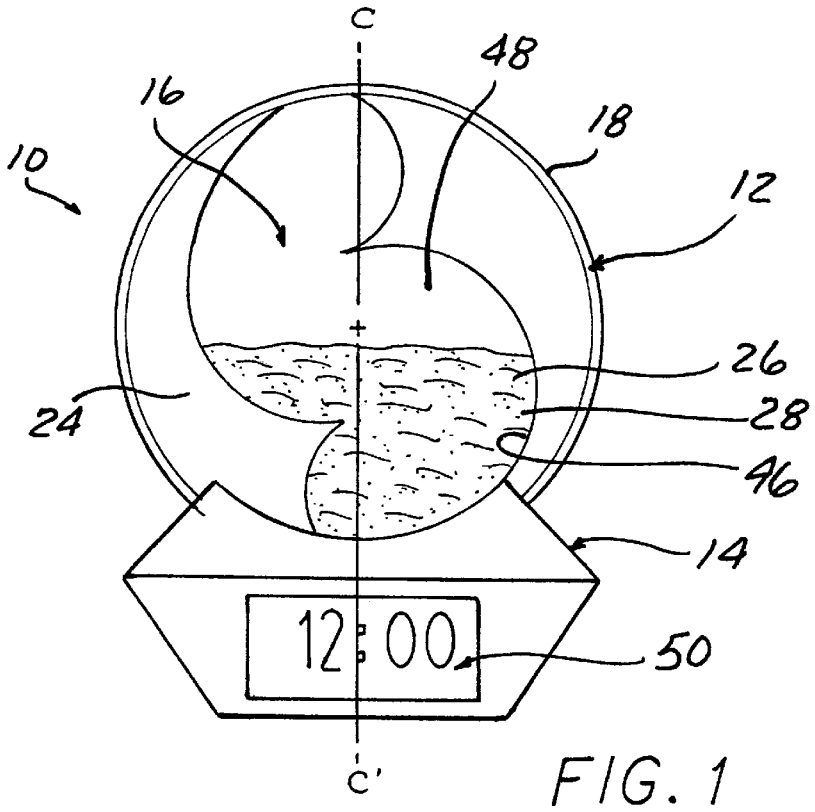
FIG. 1 is a front elevational view of an embodiment of a rotating turbulent flow display device including a display cell, rigid member, base unit, and timepieces.
Figure 2:
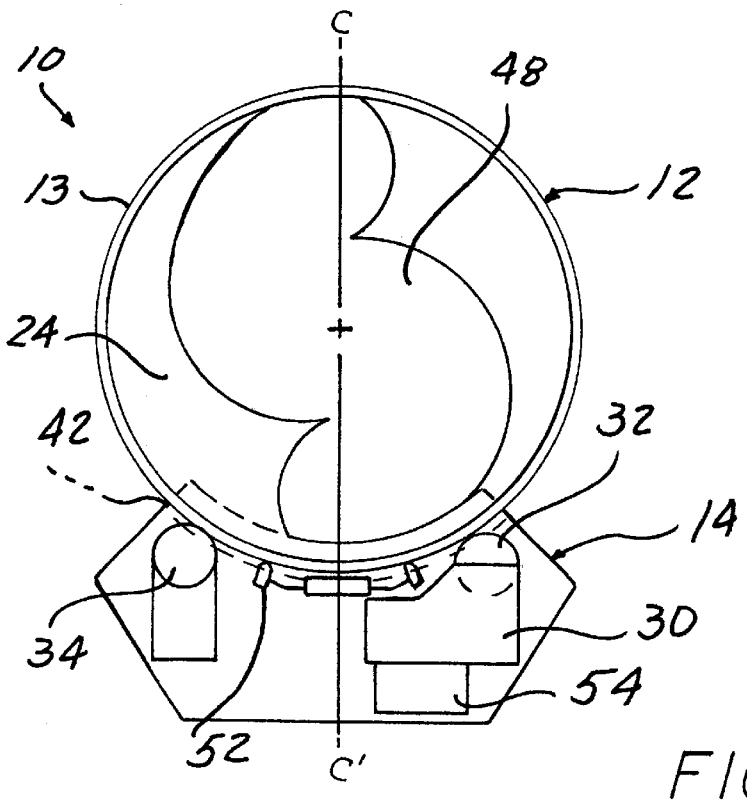
FIG. 2 is a cross-sectional view of the display cell along the longitudinal centerline C—C' of the display device of FIG. 1.
Figure 3A:
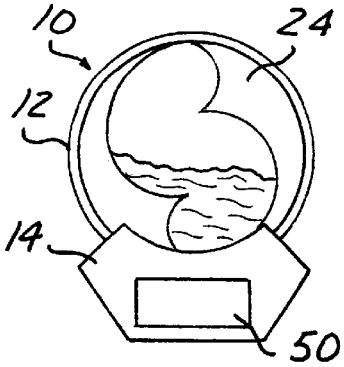
FIGS. 3A–3L are rotational sequence timing diagrams where the rigid member rotates at a rate simulating a second hand of a clock.
Figure 3B:
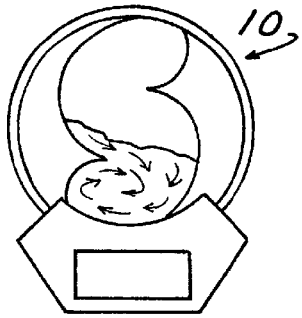
Figure 3C:
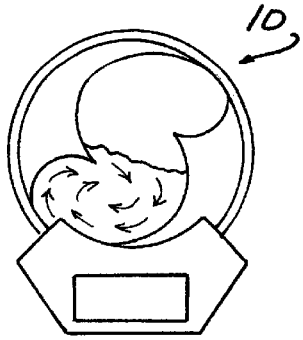
Figure 3D:
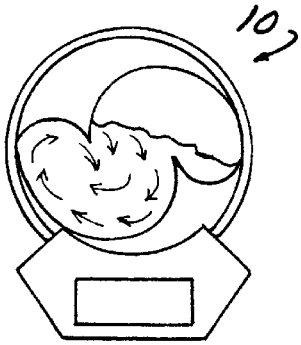
Figure 3E:
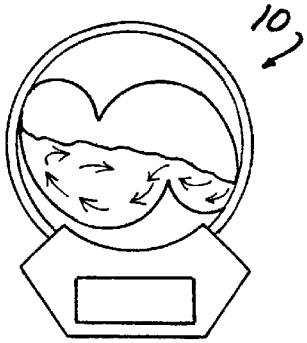
Figure 3F:
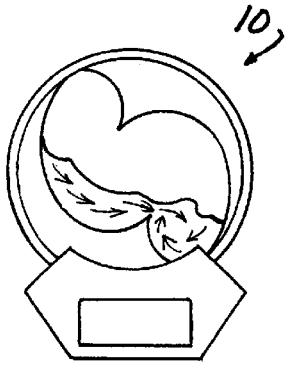
Figure 3G:
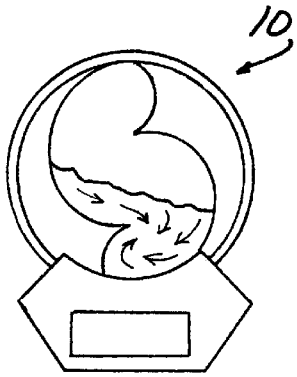
Figure 3H:
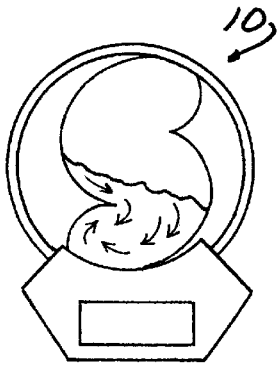
Figure 3I:
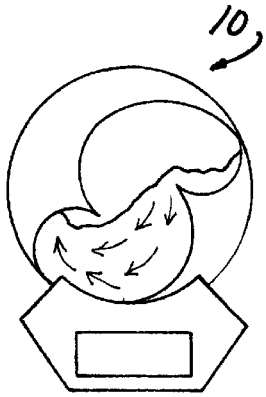
Figure 3J:
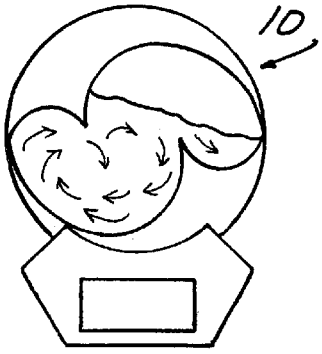
Figure 3K:
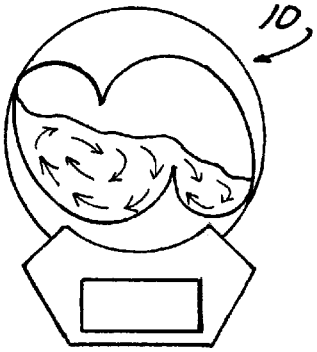
Figure 3L:
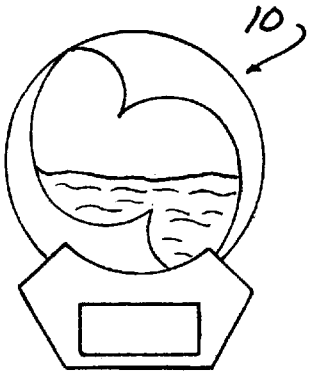

Referring now to the drawings, and to FIGS. 1 and 2 in particular, there is depicted a rotating turbulent flow display device 10 which is designed to create pleasing aesthetic visual fluid flow patterns in response to continuous rotational movement at some predetermined rate and direction.

In the embodiment of FIG. 1, the display device 10 includes a transparent display cell 12 having an outer surface 18. In this embodiment of FIG. 1, the outer surface 18 further includes a first planar surface 20 spaced apart from a second planar surface 22 to form an inner chamber shown generally as 16.

With reference now to FIG. 2, the display cell 12 is received in a base unit 14 having a complimentary aperture 42 which receives the outer surface 18 of the display cell 12. Also mounted within the base unit is a motor 30 for rotating the display cell 12. The motor 30 is preferably a 110 volt electric motor coupled to a gear array (not shown) which operatively engages a rotatable member 32, in this embodiment, a driven wheel. Preferably, the motor 30 rotates the cell 12 at a continuous rate of one revolution per minute in a clockwise direction.

As shown in the embodiment of FIG. 2, the motor 30 may be positioned in the base unit 14, offset from the transverse axis or center line of the base unit 14 to cause movement of the display cell 12. In such an embodiment, a second rotatable member 34, a non-driven wheel, rotates about a shaft (not shown) mounted within the base unit in symmetry about the center line of the base unit 14. The second rotatable member 34 provides dual support and positioning to the display cell 12.

The motor 30 may be connected to a suitable source of electric power. The power source may comprise d.c. batteries, not shown, mounted within the base unit 14 and connected to the motor 30. Alternatively, the motor 30 may be connected via an external plug to a conventional electrical outlet to supply 110 volt a.c. power to the motor 30.

Turning again to FIG. 1, mounted within the inner chamber 16 is a rigid member 24 having a shape adapted to displace the contents, if any, of the display cell 12. The rigid member 24 of FIG. 1 has an inner peripheral edge 46 formed to create a subchamber 48. In this embodiment, subchamber 48 contains at least one liquid 26 and a plurality of granular plastic particles 28. Presetting the motor 30 to rotate the display cell 12 at a rate of 1 revolution per minute, for example, will result in a rotational sequence diagram like that of FIGS. 3A–3L where the rigid member 24 simulates a second hand of a clock. As the display cell 12 rotates, the position of the rigid member 24 may represent seconds associated with the time displayed on timepiece 50 which may be mounted on the base unit 14. Moreover as the cell 12 rotates, any liquid 16 and granular particles 28 which may be within the sub-chamber 48 are displaced by the rigid member 24 to produce a pleasing flow pattern.

To enhance the visual representation of time passage, the contents of the display cell can be varied. For example, substances within the inner chamber of the display cell may include a combination of fluid or solid particles which are capable of creating a pleasing visible flow pattern in response to the rotational movement of the display cell. These substances would include, but are not limited to, fluid capable of generating distinguishable patterns during flow such as liquid soap sold under the trademark "SOFT SOAP" which includes glycol stearate which provides pearlescence characteristics, 45 drops of Winsor Newton Royal Blue water color, a plurality of particles, such as plastic beads, sand, or a plurality of light sensitive particles. The tumbling, turbulent flow of substances within the display cell creates a visual representation of the "flow" of time.

Figure 4:
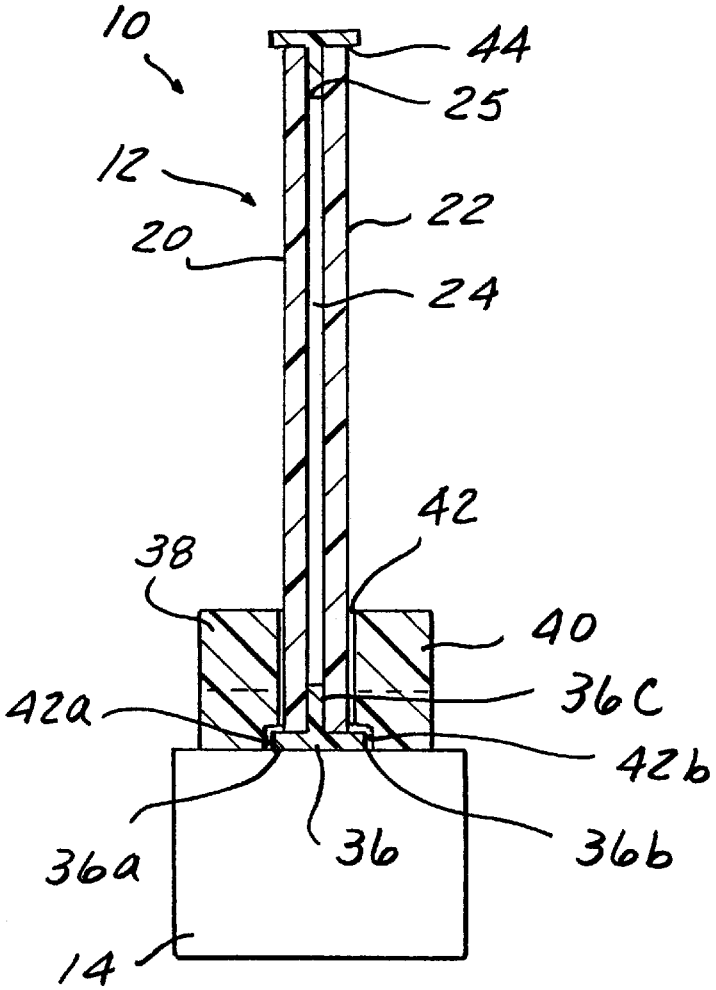
FIG. 4 is a lateral cross-sectional view of the device shown in FIG. 1.

A detailed description of the display cell 12 as it is received in the base unit 14 may be had by referring to FIG. 4. As shown in FIGS. 1–4, the display cell 12 is a disc. The outer surface 18 includes a first planar surface 20 spaced apart from a second planar surface 22 to create an inner chamber 16 generally which in the cross-sectional view of FIG. 4, is occupied by rigid member 24. In FIGS. 1–4 of these embodiments, the display cell 12 is rotatably locked into the base unit by means of a flange 36 having opposed ends 36a and 36b which extend beyond the planar surfaces 20 and 22 of the display cell 12 respectively. Planar surfaces 20 and 22 are received in a complimentary aperture 42 complementary to the outer surface of the display cell 18 formed between a pair of upstanding members 38 and 40. Each upstanding member 38 and 40 has formed within in it a complementary groove 42*a* and 42*b* for receiving ends 36*a* and 36*b* of the flange 36 so that flange 36 respectively rotatably secures the display cell 12 to the base unit 14. Flange 36 is preferably a flat plastic strip having a T-shaped cross section where the base of the T, 36*c,* is received between the planar surfaces 20 and 22, and the top of the T is formed between ends 36*a* and 36*b* and is sealingly joined to the outer surface of the display cell about an inner peripheral surface 44. While flange 36 may be provided as a means for rotatably securing the display cell 12 within the complementary apertures of the base unit 42, 42*a* and 42*b,* separately from the rigid member 24, it may also be formed as an integral part of the rigid member 24, fused to the member 24 about its outer peripheral edge 25. The rigid member 24 may also be transparent and may be made of plastic.

Figure 5:
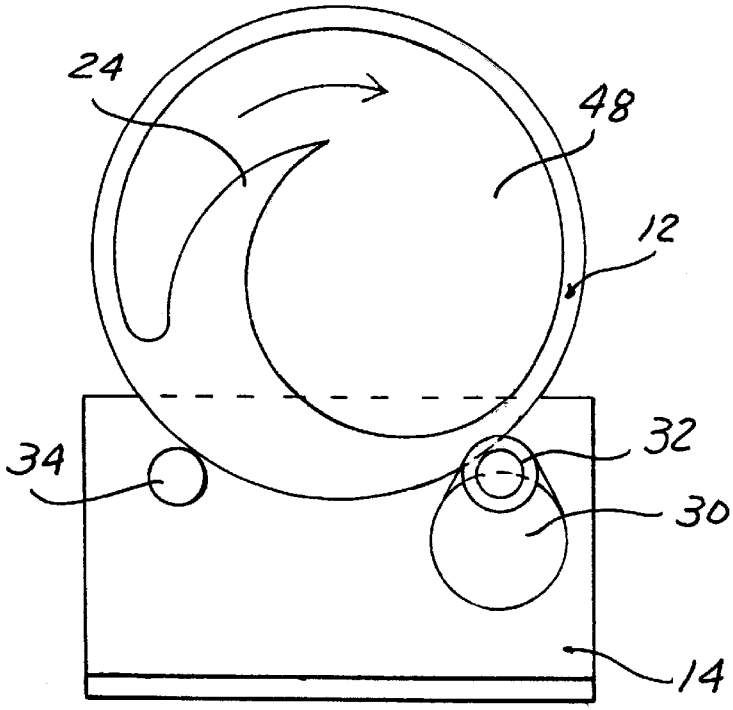
FIG. 5 is a cross-sectional view of another embodiment of the claimed rotating turbulent flow display device illustrating a saw-tooth shaped rigid member.
Figure 6:
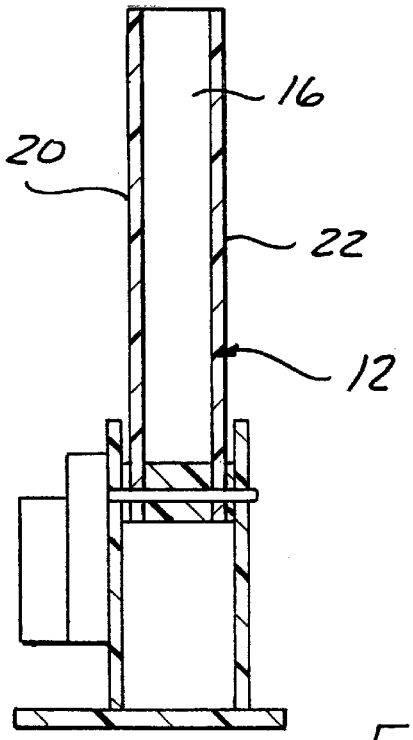
FIG. 6 is a lateral cross-sectional view of the device shown in FIG. 5.

Finally, FIGS. 5 and 6 disclose yet another embodiment of the display cell 12 including a rigid member 24 having an inner peripheral edge 46 defining a subchamber 48 shaped like a comma. In particular, FIG. 6 discloses planar surfaces 20 and 22 spaced apart from one another to define an inner chamber 16 measuring a width of approximately one inch. In the embodiment of FIGS. 5 and 6, it is desirable that the substance within the inner chamber 16 be a plurality of small plastic beads, such as 2 mm beads, for example, to produce thousands of swirling patterns as the display cell 12 is rotated. The beads are preferably of different colors.

What is claimed is:

1. A rotating turbulent display device comprising:

a transparent display cell having an outer surface and an inner chamber;

a base unit having a complementary aperture for rotatably receiving the outer surface of the display cell;

a motor mounted on the base unit, said motor unit including a rotating member operable to continuously rotate said display cell at a predetermined rate; and a flowable substance disposed within the inner chamber of the display cell capable of exhibiting a visible flow pattern in response to movement; and a rigid member mounted within the inner chamber adapted to displace the substance within the inner chamber to create a visible flow pattern, the rigid member including an inner peripheral edge defining first and second subchambers within the inner chamber, the first and second subchambers disposed in fluid flow communication, the substance contained within and continuously flowable over the inner peripheral edge between the subchambers during rotation of the display cell.

2.The display device of claim 1, wherein said substance is a fluid.

3. The display device of claim 1, wherein said substance is comprised of a plurality of granular particles.

4. The display device of claim 1, wherein said substance is a mixture of fluid and a plurality of granular particles capable of exhibiting a visible flow pattern through said fluid in response to movement.

5. The display device of claim 1, wherein said substance is sensitive to ultraviolet light.

6. The display device of claim 1, wherein the display cell includes a peripheral surface, a first planar surface and a second planar surface spaced apart from one another to define said inner chamber.

7. The display device of claim 6 further including a flange attached about said peripheral surface and extending axially beyond the first and second planar surfaces, and wherein the complementary aperture of the base unit is defined by a pair of spaced apart upstanding members for receiving the first and second planar surfaces of the display cell therebetween, each of said upstanding members having a complementary groove for receiving said flange therebetween so that the display cell is rotatably secured to the base by said flange.

8. The display device of claim 1, further including fat least one light source disposed within said base unit.

9. The display device of claim 1, wherein the motor is mounted eccentrically within said base unit and include a second rotatable member, supportively engaged with the outer surface of the display cell mounted centrally within said base unit.

10. The display device of claim 1, further comprising a timepiece mounted on said base unit for displaying a measure of time.

11. The display device of claim 1, wherein said predetermined rate is one revolution per minute.

12. The display device of claim 1, wherein said predetermined rate is two revolutions per day.

* * * * *